US006796762B2

(12) United States Patent
Vicars, III et al.

(10) Patent No.: US 6,796,762 B2
(45) Date of Patent: Sep. 28, 2004

(54) BOOM AND LINKAGE MECHANISM FOR SKID-STEER LOADER

(75) Inventors: Joe W. Vicars, III, Louisville, KY (US); Michael J. Hilvers, Fort Jennings, OH (US); David R. Smith, Fort Jennings, OH (US)

(73) Assignee: Unverferth Manufacturing Company, Inc., Kalida, OH (US)

( * ) Notice: Subject to any disclaimer, the term of this patent is extended or adjusted under 35 U.S.C. 154(b) by 0 days.

(21) Appl. No.: 10/386,107

(22) Filed: Mar. 12, 2003

(65) Prior Publication Data

US 2004/0018078 A1 Jan. 29, 2004

Related U.S. Application Data

(60) Provisional application No. 60/363,097, filed on Mar. 12, 2002.

(51) Int. Cl.[7] ..... B66C 23/00
(52) U.S. Cl. ..... 414/685; 414/686
(58) Field of Search ..... 414/685, 686, 414/700, 680, 697

(56) References Cited

U.S. PATENT DOCUMENTS

| | | | | |
|---|---|---|---|---|
| 3,215,292 A | | 11/1965 | Halls | |
| 4,355,946 A | | 10/1982 | Wykhuis et al. | |
| 5,169,278 A | | 12/1992 | Hoechst et al. | |
| 5,511,932 A | | 4/1996 | Todd et al. | |
| 5,609,464 A | | 3/1997 | Moffitt et al. | |
| 5,807,061 A | | 9/1998 | Donoghue et al. | |
| 5,878,363 A | * | 3/1999 | Koehler | 701/50 |
| 6,109,858 A | | 8/2000 | Deneve et al. | |
| 6,132,163 A | | 10/2000 | Andrews et al. | |

OTHER PUBLICATIONS

Chironis, N., "Mechanisms, Linkage, and Mechanical Controls", *McGraw–Hill Book Company*, (1965) 4 pages.
Schwamb, P., et al., "Elements of Mechanism", *Sixth Edition, Second Printing* (*1947*), 3 pages.

* cited by examiner

*Primary Examiner*—Christopher J. Novosad
(74) *Attorney, Agent, or Firm*—Rothwell, Figg, Ernst & Manbeck

(57) ABSTRACT

A boom and linkage mechanism for a skid-steer loader includes a frame and a right and a left loader arms. An implement may be vertically pivotally mounted to the forward ends of the loader arms, and a pair of tilt actuators may be respectively connected between the forward ends and the implement. Right and left forward guide links are connected between the frame and the loader arms. Right and left rearward guide links are connected substantially proximate to a rear of the frame and the loader arms. The lower ends of the rear guide links may be substantially lower than the lower ends of the forward guide links. Right and left lift actuators may be connected between the frame and the loader arms. The right and left lift actuators may extend and retract to raise the right and left loader arms such that the implement moves between a fully lowered position and a fully raised position, and wherein the fully raised position is located substantially vertically above the fully lowered position.

8 Claims, 12 Drawing Sheets

BOOM AND LINKAGE MECHANISM FOR SKID-STEER LOADER

CROSS-REFERENCE TO RELATED APPLICATIONS

This application claims the benefit of U.S. Provisional Application Serial No. 60/363,097, filed Mar. 12, 2002, the disclosure of which is incorporated by reference.

FIELD OF THE INVENTION

The invention relates to utility vehicles in general, and to skid-steer loaders in particular.

DESCRIPTION OF THE RELATED ART

Skid-steer loaders are highly maneuverable, agile, compact vehicles with a wide range of applications in the agricultural, industrial and construction fields. Skid-steer loaders are useful for raising, lifting, carrying, and pushing objects. Their compact nature and low profile allows them to enter enclosed spaces and maneuver under low overhead areas. Their low center of gravity which results from their compact nature also allows them to traverse uneven terrain without overturning.

Skid-steer loaders may include an engine, a boom assembly and an operator's compartment mounted on a frame supported by four wheels. The engine may be placed in the rear of the skid-steer loader to provide a counterweight for a payload.

The engine powers a main drive system and a lift system for the boom assembly. The direction in which the skid-steer loader travels depends on the angular velocities of the wheels on one side of the vehicle relative to the angular velocities of those on the other side. The skid-steer loader travels in a substantially straight line while the angular velocities of the wheels on both sides of the skid-steer loader are non-zero and relatively equal. The vehicle turns if the angular velocities of the wheels on one side of the vehicle are different than the angular velocities of those on the other side. The vehicle will, in general, turn toward the side of the vehicle on which the angular velocities of the wheels are lower than those of the other side. The degree of curvature of the turn is generally proportional to the magnitude of the velocity differential, after accounting for slippage.

A pair of hydrostatic pumps coupled to hydrostatic motors mounted on the left and right sides of the frame are driven by the engine. The wheels on the left and right sides of the vehicle are driven by the hydrostatic motors through gears, chains, shafts, or sprockets. The angular velocities of the wheels may depend on the volume and direction of flow of the hydraulic fluid supplied to the hydrostatic motors. The volume and direction of flow of the hydraulic fluid supplied to the hydrostatic motors on either side of the skid-steer loader may be controlled from the operator's compartment by valves actuated by levers.

A boom assembly comprising a pair of lift arms supported by a linkage may be mounted pivotally directly to the main frame, or to a support frame attached to the main frame. The boom assembly generally supports an attachment or implement for lifting, carrying, and pushing objects. Hydraulic lift cylinders coupled to the lift arms or a component of the linkage raise and lower the boom assembly by extending and retracting. The hydraulic lift cylinders are often powered by a hydraulic system that is separate from that used to drive the wheels. This hydraulic system may also power tilt cylinders connected between the boom assembly and the implement.

A separate hydraulic system is usually used in skid-steer loaders to power the boom assembly. This hydraulic system can also be used to actuate one or two tilt cylinders which pivot the implement relative to the lift arms for dumping, leveling, or curling the implement. Hydraulic fluid supplied to the lift and tilt cylinders from an implement pump may be controlled by valves actuated by a pair of foot pedals at the front of the operator's compartment.

SUMMARY OF THE INVENTION

In several aspects, the invention may provide a boom and linkage mechanism for a skid-steer loader which includes a frame having a right and a left side, a right and a left loader arm located respectively on the right and left sides of the frame, each of the right and left loader arms having a forward and a rearward end, an implement vertically pivotally mounted to the forward ends, a pair of tilt actuators respectively connected between the forward ends and the implement, a right forward guide link having a first right lower end portion pivotally connected to the right side of the frame and a first right upper end portion pivotally connected substantially between the forward and rearward ends of the right loader arm, a left forward guide link having a first left lower end portion pivotally connected to the left side of the frame and a first left upper end portion pivotally connected substantially between the forward and rearward ends of the left loader arm, a right rearward guide link having a second right lower end portion pivotally connected substantially proximate to a rear of the right side of the frame and a second right upper end portion pivotally connected substantially proximate to the rearward end of the right loader arm, the second right lower end portion being substantially lower than the first right lower end portion, a left rearward guide link having a second left lower end portion pivotally connected substantially proximate to a rear of the left side of the frame and a second left upper end portion pivotally connected substantially proximate to the rearward end of the left loader arm, the second left lower end portion being substantially lower than the first left lower end portion, a right lift actuator having a first right lower cylinder portion pivotally connected to the right side of the frame between the first right lower end portion and the second right lower end portion, and a first right upper rod portion pivotally connected substantially intermediate between the first right upper end portion and the second right lower end portion, and a left lift actuator having a first left lower cylinder portion pivotally connected to the left side of the frame between the first left lower end portion and the second left lower end portion, and a first left upper rod portion pivotally connected substantially intermediate between the first left upper end portion and the second left lower end portion, wherein the pair of lift actuators extend and retract to raise the pair of loader arms such that the implement moves between a fully lowered position and a fully raised position, and wherein the fully raised position is located substantially vertically above the fully lowered position.

DETAILED DESCRIPTION OF THE PREFERRED EMBODIMENTS

Figure 1:
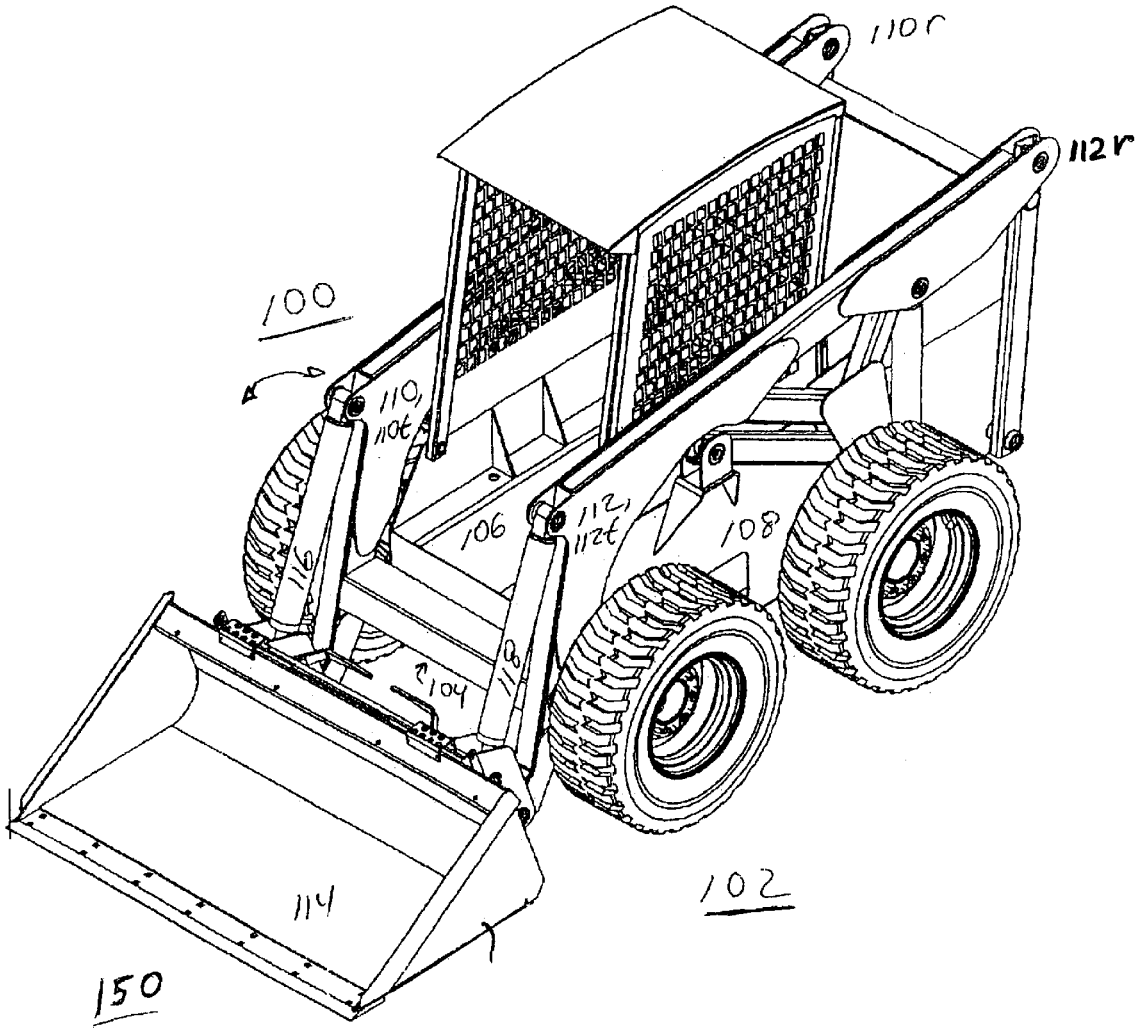
FIG. 1 is a three-quarter view of a skid-steer loader according to an embodiment of the invention.

Skid-steer loaders use booms supported by linkages to raise and lower their implements. The boom of a skid-steer loader may carry an implement such as a bucket or a fork. A bucket or a fork may be used to lift things. Skid-steer loaders have booms supported by linkages to raise and lower their implements, rather than masts, to give them a low profile when the boom is retracted and to reduce their height. A boom and linkage can be designed to collapse down on either side of the occupant's cabin. Masts, on the other hand, which are comprised of several telescoping sections, can generally be no shorter than the length of the longest section.

A skid-steer loader may be used to load a receptacle such as gondola, a dump truck, a wagon, or a trailer. Since a skid-steer loader is generally quite low and compact in the first place, the boom may be required to raise a load quite high, relative to the height of the skid-steer loader, to dump the load over the side of the receptacle. It may be desirable for the skid-steer loader to be able to raise its implement as high as possible.

A skid-steer loader may have a relatively high center of gravity while the load is raised. A skid-steer loader may consequently be relatively less stable while the load is raised. If the skid-steer loader is moved while the load is raised, the risk of the load falling over may be exacerbated by the height of the load. The skid-steer loader may therefore need to be maneuvered quite close to a gondola before the load is raised so that movement while the load is raised is minimized.

Furthermore, skid-steer loaders are often operated on uneven surfaces such as piles of refuse or slag. A skid-steer loader may be more likely to fall over while it is being maneuvered over a rough or uneven surface while a load is raised. It may be desirable, then, if the amount of movement of the skid-steer loader that is necessary with the load raised be minimized.

Receptacles often have straight sides. If the motion of the boom and linkage makes the implement follow a relatively circuitous path on the way up it could strike the wall of the receptacle. If, for example, the path of the implement bellies out while the receptacle is being raised, and the skid-steer loader begins to raise the load from a position next to the side of the receptacle, the path of the implement may intersect the wall of the receptacle. If the implement strikes the wall of the receptacle while the load is being raised, the load may fall off. It may be desirable for the implement to rise in a relatively straight line to clear the side of the receptacle.

Operators of skid-steer loaders may correct for non-linearities in a path of the implement by moving the skid-steer loader closer to or away from the wall of a receptacle while a load is being raised. Since a skid-steer loader is less stable while the load is raised than while the load is lowered, it may be desirable to make the path of the implement as straight as possible, to minimize a need for an operator to move the skid-steer loader forward or back while the load is raised.

If the path of the implement is non-linear, the load may move out away from the skid steer loader while it is being raised. If the load moves out away from the skid steer loader while it is being raised, the center of gravity of the skid-steer loader may move out as well. If the load moves out too far, the skid-steer loader may be less stable. Since a non-linear path of the implement may be less stable than a linear path, it may also be desirable to make a path of the implement as straight as possible to improve the stability of the skid-steer loader.

In FIG. 1 is shown a boom and linkage mechanism 100 for a skid-steer loader 102 according to a first embodiment of the invention. The boom and linkage mechanism 100 includes a frame 104 having a lower right side 106 and a lower left side 108.

Frame 104 may be comprised of subframes, or it may be fabricated in one piece. Frame 104 may be formed in one or several pieces by casting or hydro-forming, or it may be welded, bolted or riveted together from separate pieces. Frame 104 may encompass the occupant's cage, for greater protection from falling objects or collisions. Lower right and lower left sides 106, 108 will generally be substantially symmetrical about a longitudinal centerline of skid-steer loader 102. Furthermore, lower right and lower left sides 106, 108 will generally be substantially mirror images of one another.

A right loader arm 110 is located on a right side of frame 104, while a left loader arm 112 is located on a left side. Lower right and lower left sides 106, 108 and right and left loader arms 110, 112 may be solid, or they may have a section such as a hollow box section, an I-beam, a channel section, or an L section. Lower right and lower left sides 106, 108 and right and left loader arms 110, 112 may have disparate sections of varying size at various points along their lengths. The size of a section may vary in proportion to an expected or predicted bending moment.

Right loader arm 110 may have a right forward end 110*f* and a right rearward end 110*r*. Left loader arm 112 may have a left forward end 112*f* and a left rearward end 112*r*. An implement 114 may be vertically pivotally mounted to forward ends 110*f*, 112*f*.

Implement 114 may be a bucket, a scoop, a shovel, an auger, a snow blower, a plow, a post-hole digger, a dredge, a fork, an air hammer, or a skid. If implement 114 requires a source of power, it may be powered by the engine of skid-steer loader 102, such as over a power take off (PTO) or by tapping the hydraulic system. Implement 114 may have a separate hydrostatic pump or auxiliary source of power as well.

A pair of tilt actuators 116, 118 are connected between forward ends 110*f*, 112*f* and implement 114. Tilt actuators 116, 118 may be an hydraulic cylinder, a double-acting hydraulic cylinder, a pneumatic cylinder, a screw jack, or a rack and pinion. Tilt actuators 116, 118 may receive power from the skid-steer loader's engine, or they may have a separate hydrostatic pump or auxiliary source of power.

Loader arms 110, 112 may be substantially L-shaped, with what would be the lower leg of the L located at the forward ends 110*f* and 112*f*. Tilt actuators 116, 118 may be connected to the bend of the L of loader arms 110, 112, while implement 114 pivots around a tip of the lower leg of the L. This may allow tilt actuators 116, 118 to apply leverage to implement 114. Such leverage may be important in the event implement 114 is used to pry something loose.

Figure 2:
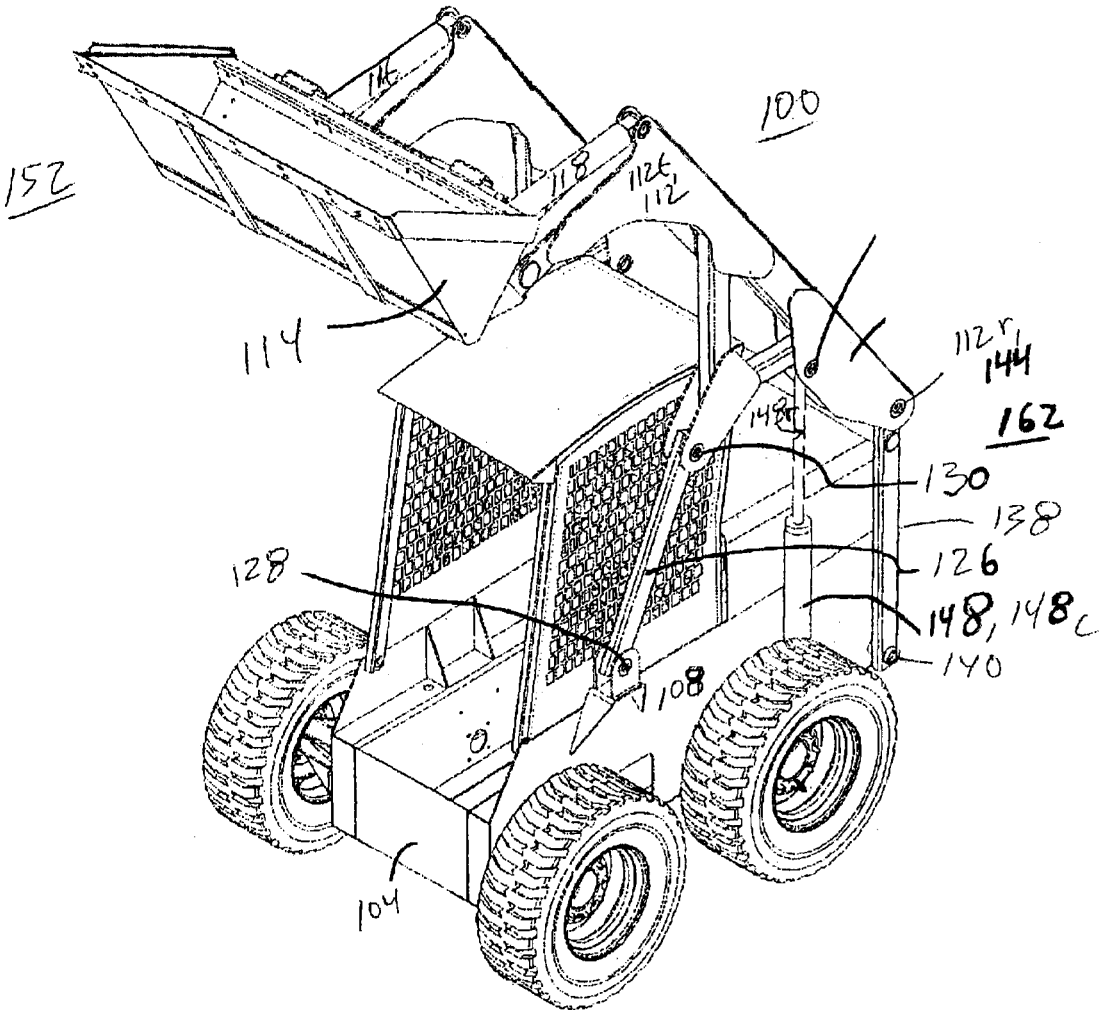
FIG. 2 is a three-quarter view of a skid-steer loader according to the embodiment shown in FIG. 1, with the implement raised.

As shown in FIG. 2, a left forward guide link 126 having a first left lower end portion 128 may be pivotally connected to lower left side 108 of frame 104. Left forward guide link 126 may also have a first left upper end portion 130 pivotally connected substantially between forward and rearward ends 112*f*, 112*r* of left loader arm 112.

Figure 3:
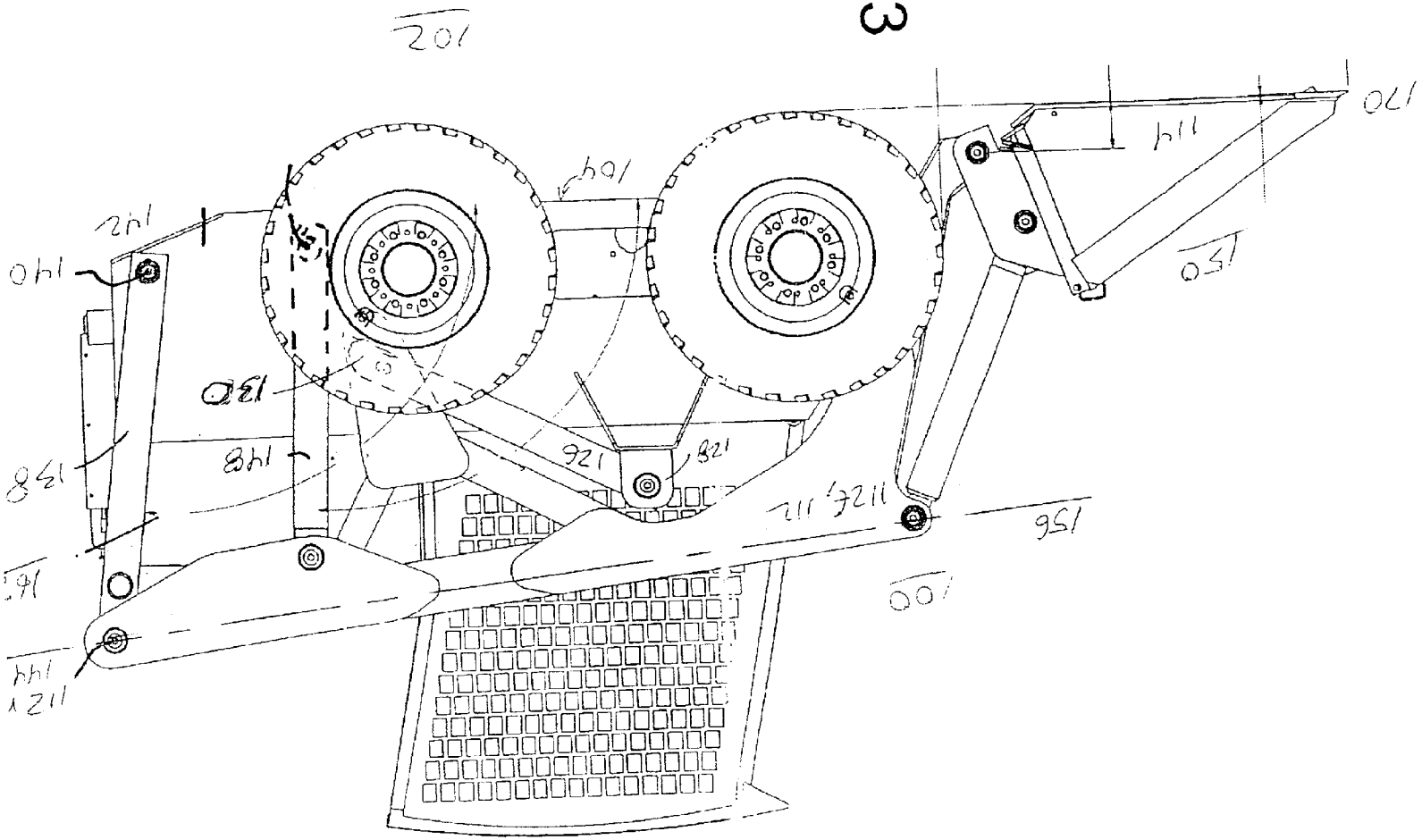
FIG. 3 is a left side view of a skid-steer loader according to the embodiment shown in FIG. 1, with the implement lowered.

As shown in FIG. 3, first left upper end portion 130 may be offset substantially from a centerline 156 of left loader arm 112. This may reduce a length of left forward guide link 126. This may also allow left forward guide link 126 to nest underneath left loader arm 112 when left loader arm 112 is in a lowered position. Left forward guide link 126 may be solid, or it may have a section such as a hollow box section, an I-beam, a channel section, or an L section. Left forward guide link 126 may have disparate sections of varying size at various points along its length.

A left rearward guide link 138 having a second left lower end portion 140 may be pivotally connected substantially proximate to a rear 142 of lower left side 108 of frame 104 and a second left upper end portion 144 may be pivotally connected substantially proximate to left rearward end 112*r* of left loader arm 112. Left rearward guide ink 138 may be solid, or it may have a section such as a hollow box section, an I-beam, a channel section, or an L section. Left rearward guide link 138 may have disparate sections of varying size at various points along its length.

Left loader arm 112, left forward guide link 126, left rearward guide link 138, and lower left side 108 form a left four bar linkage 162 on the left side of skid-steer loader 102 as well. Since left forward guide link 126 is generally at an angle relative to a horizontal plane, left loader arm 112 will move up and down as left forward guide link 126 pivots around first left lower end portion 128. Since left forward guide link 126 is generally at a angle relative to a horizontal plane, first left lower end portion 128 will react a horizontal force imposed on left loader arm 112 due to pushing or plowing with implement 114.

If a motion of rearward end 112*r* were confined to a horizontal plane, left loader arm 112 would seesaw around first left upper end portion 130 as left forward guide link 126 pivoted around first left lower end portion 128, moving right forward end 112*f* in a substantially vertical line. Since rearward end 112*r* is connected to second left upper end portion 144, however, and second left upper end portion 144 pivots around second left lower end portion 140, a motion of left forward end 112*f* is circular.

The motion of left forward end 112*f* will approach a vertical line asymptotically as a length of left rearward guide link 138 gets very, very large. As it is, the motion of left forward end 112*f* may approximate a substantially vertical line if a length of left rearward guide link 138 is made reasonably long.

The length of left rearward guide link 138 may be made reasonably long by attaching second left lower end portion 140 to a relatively low point of lower left side 108. In one embodiment, second left lower end portion 140 is substantially lower than first left lower end portion 128. The motion of left forward end 112*f* may also approximate a substantially vertical line if a rotation of left rearward guide link 138 about second left lower end portion 140 is restricted to a relatively small angle.

Figure 4:
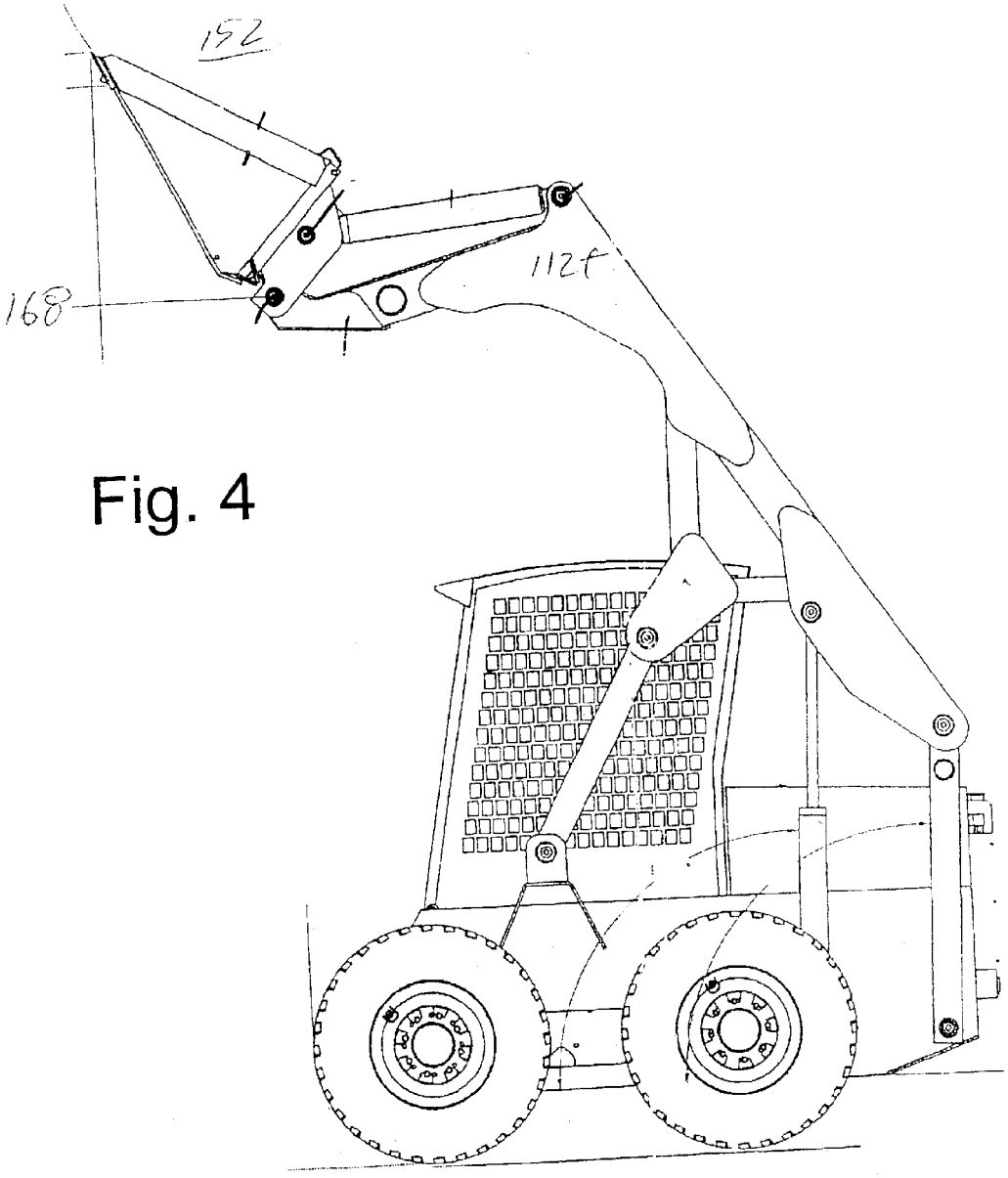
FIG. 4 is a left side view of a skid-steer loader according to the embodiment shown in FIG. 1, with the implement raised.

Furthermore, if the length of left rearward guide link 138 is made reasonably long and a rotation of left rearward guide link 138 is restricted to a relatively small angle, an upper end point 168 of the motion of left forward end 112*f*, shown in FIG. 4, may be made to be substantially vertical relative to a lower end point 170 of the motion of left forward end 112*f*, even though the motion of left forward end 112*f* between upper end point 168 and lower end point 170 may be slightly circuitous.

A left lift actuator 148 may be connected between lower left side 108 and left loader arm 112 to raise and lower left loader arm 112. Left lift actuator 148 may have a first left lower cylinder portion 148*c* pivotally connected to lower left side 108 between first left lower end portion 128 and second left lower end portion 140. A first left upper rod portion 148*r* of left lift actuator 148 may be pivotally connected substantially intermediate between first left upper end portion 130 and second left upper end portion 144. First left upper rod portion 148*r* may be slidably disposed in first left lower cylinder portion 148*c* so that first left upper rod portion 148*r* extends and retracts relative to first left lower cylinder portion 148*c*. Left lift actuator 148 may be an hydraulic cylinder, a double-acting hydraulic cylinder, a pneumatic cylinder, a screw jack, or a rack and pinion.

Figure 5:
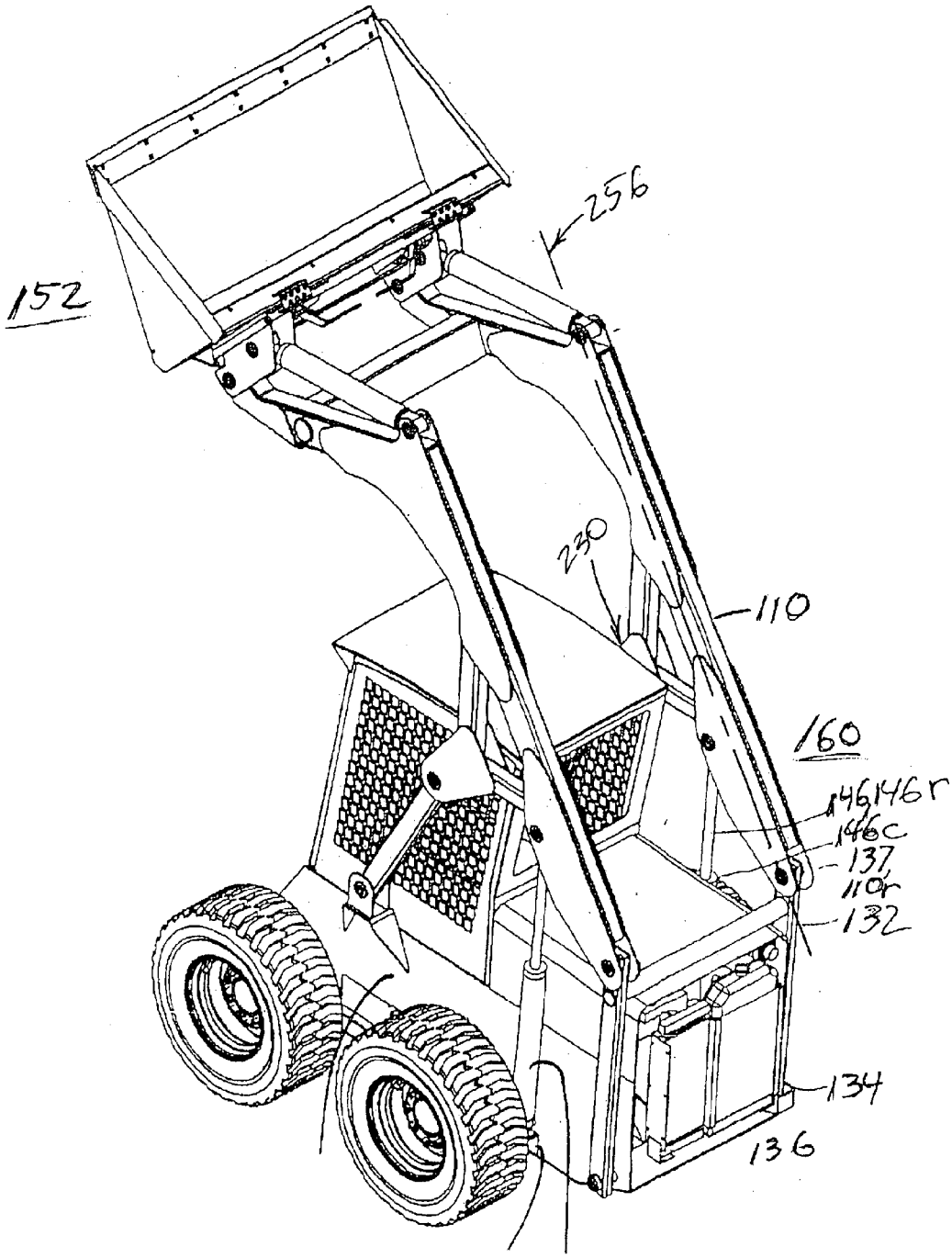
FIG. 5 is a three-quarter view of a skid-steer loader according to the embodiment shown in FIG. 1, with the implement raised.
Figure 6:
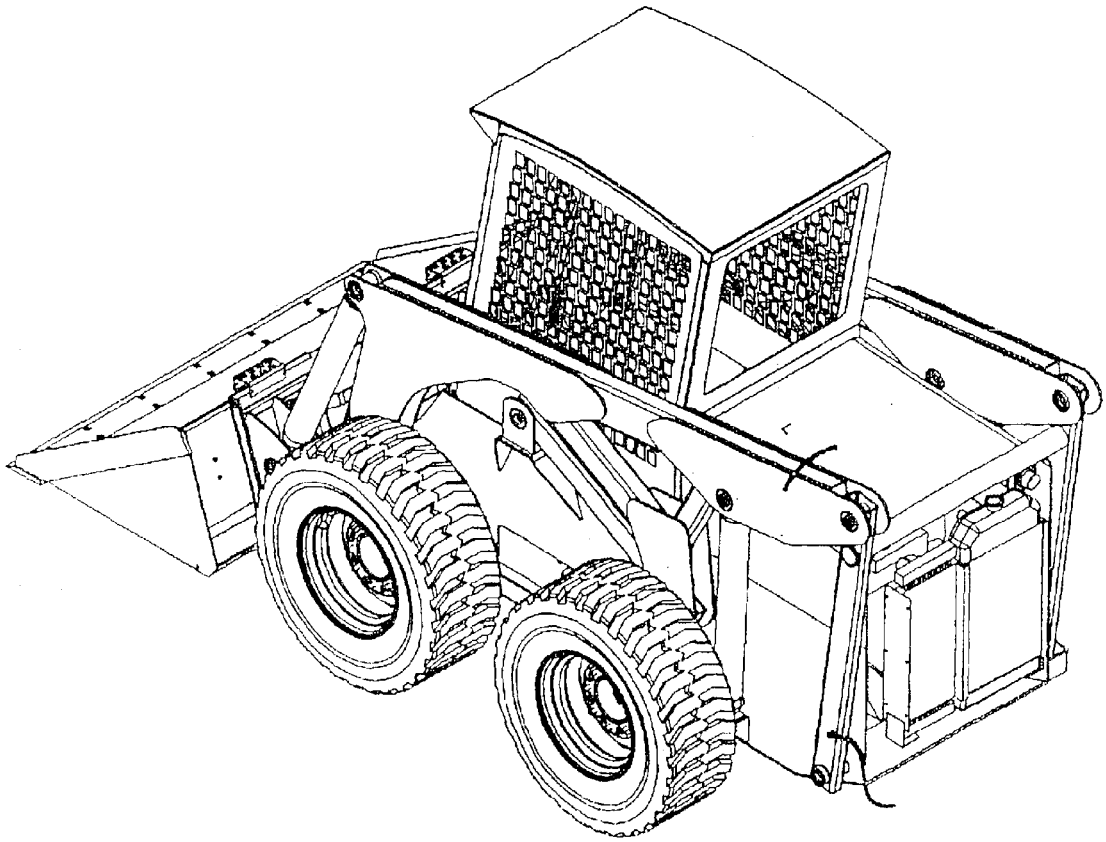
FIG. 6 is a three-quarter view of a skid-steer loader according to the embodiment shown in FIG. 1, with the implement lowered.
Figure 7:
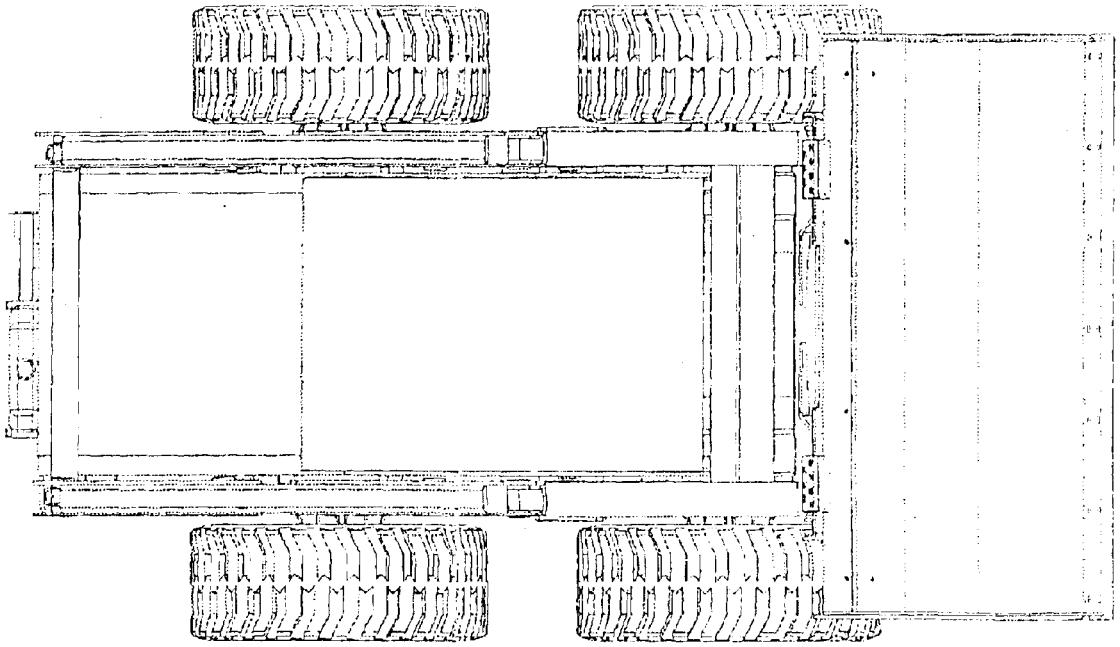
FIG. 7 is a bottom view of a skid-steer loader according to the embodiment shown in FIG. 1.
Figure 8:
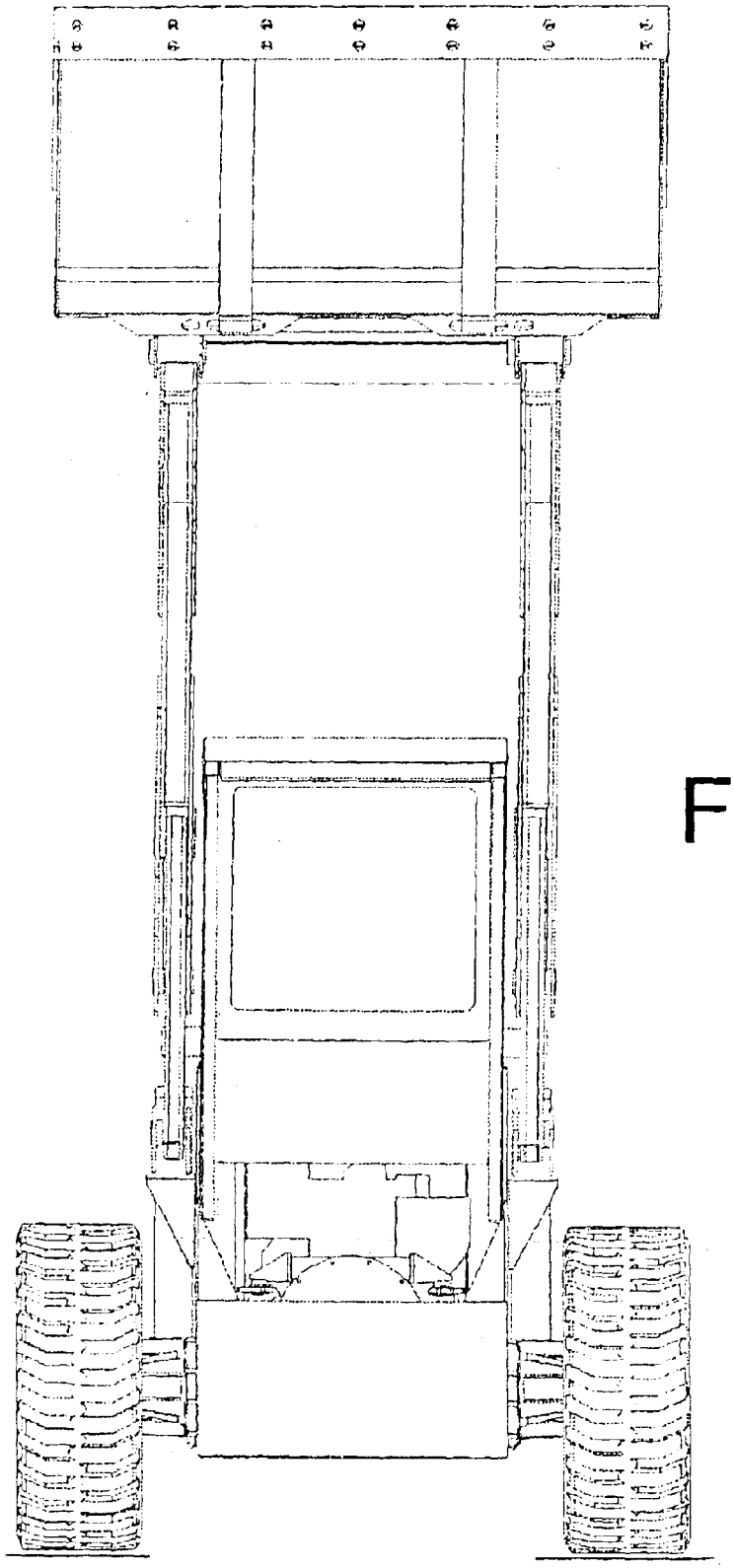
FIG. 8 is a front view of a skid-steer loader according to the embodiment shown in FIG. 1, with the implement raised.
Figure 9:
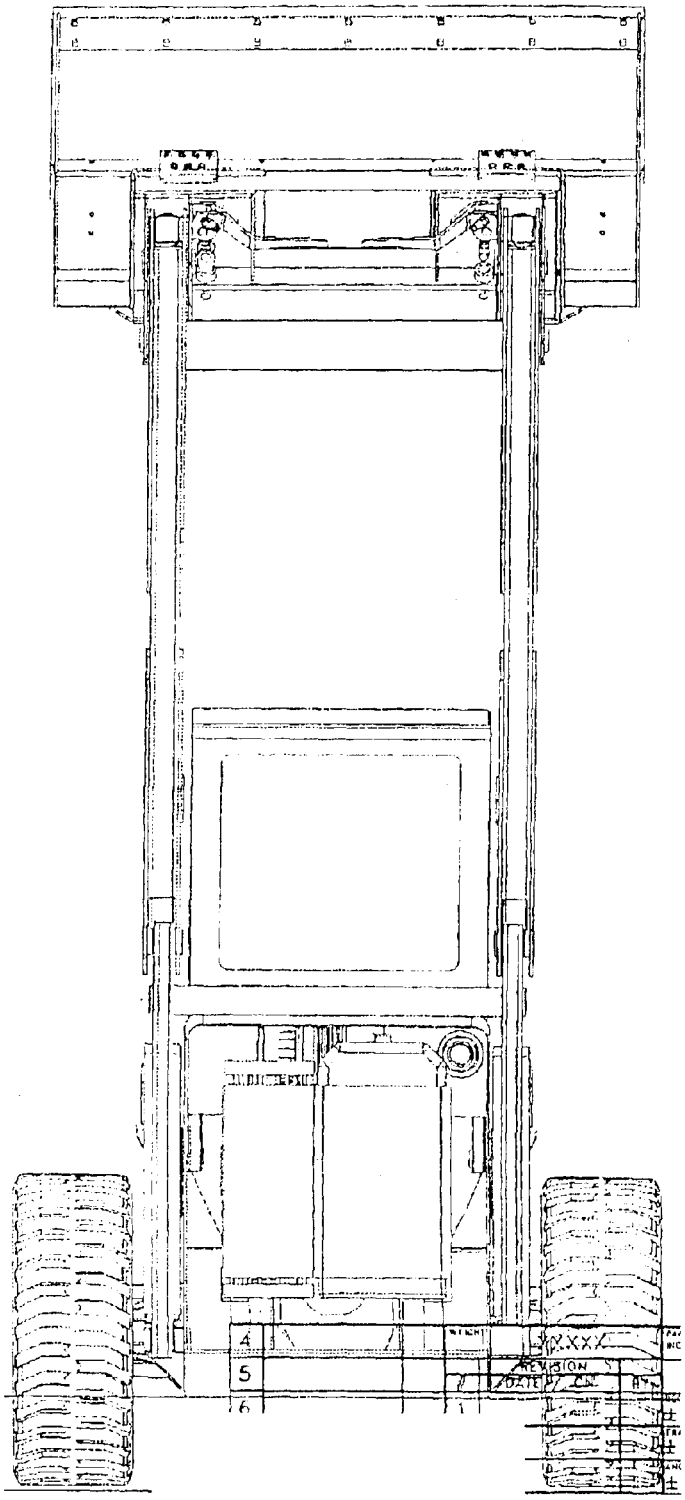
FIG. 9 is a rear view of a skid-steer loader according to the embodiment shown in FIG. 1, with the implement raised.
Figure 10:
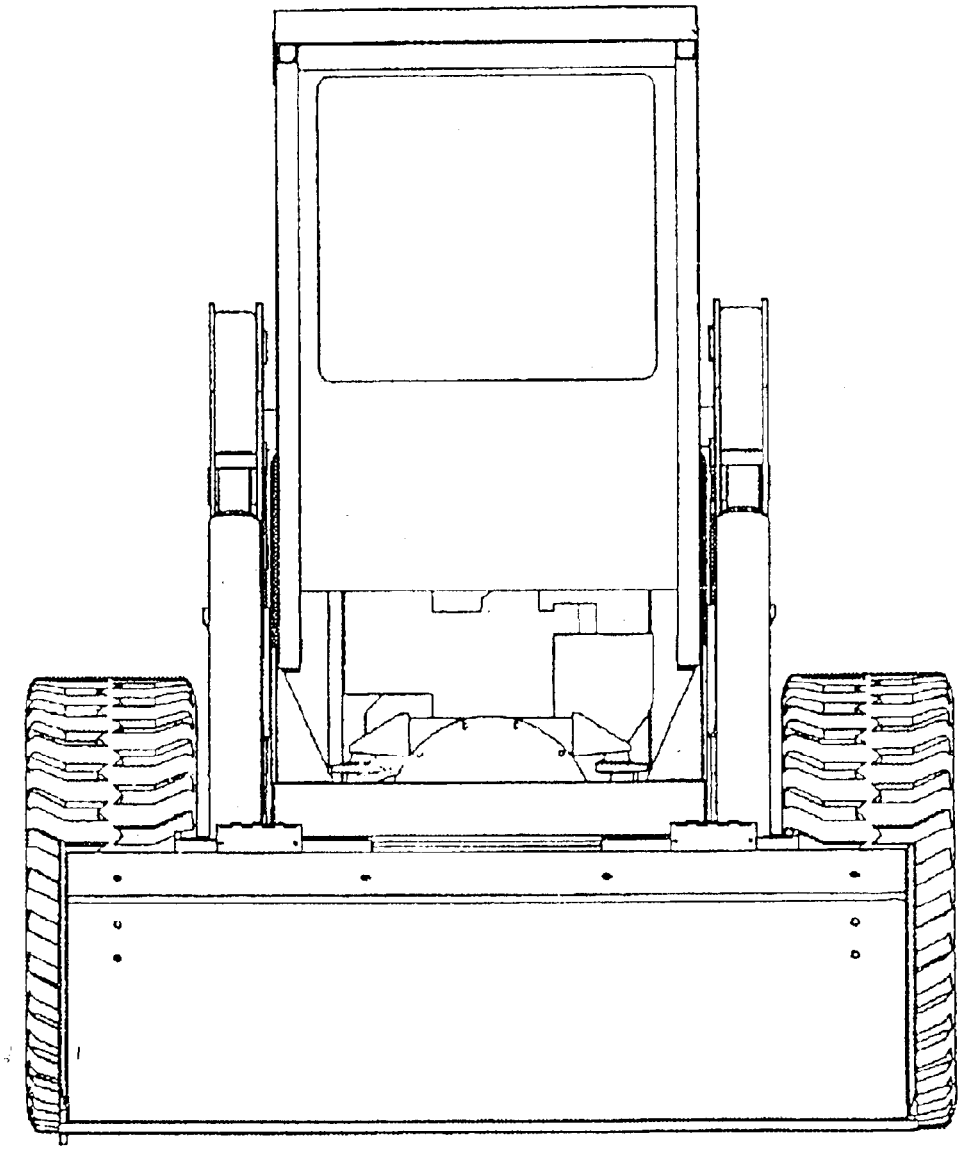
FIG. 10 is a front view of a skid-steer loader according to the embodiment shown in FIG. 1, with the implement lowered.
Figure 11:
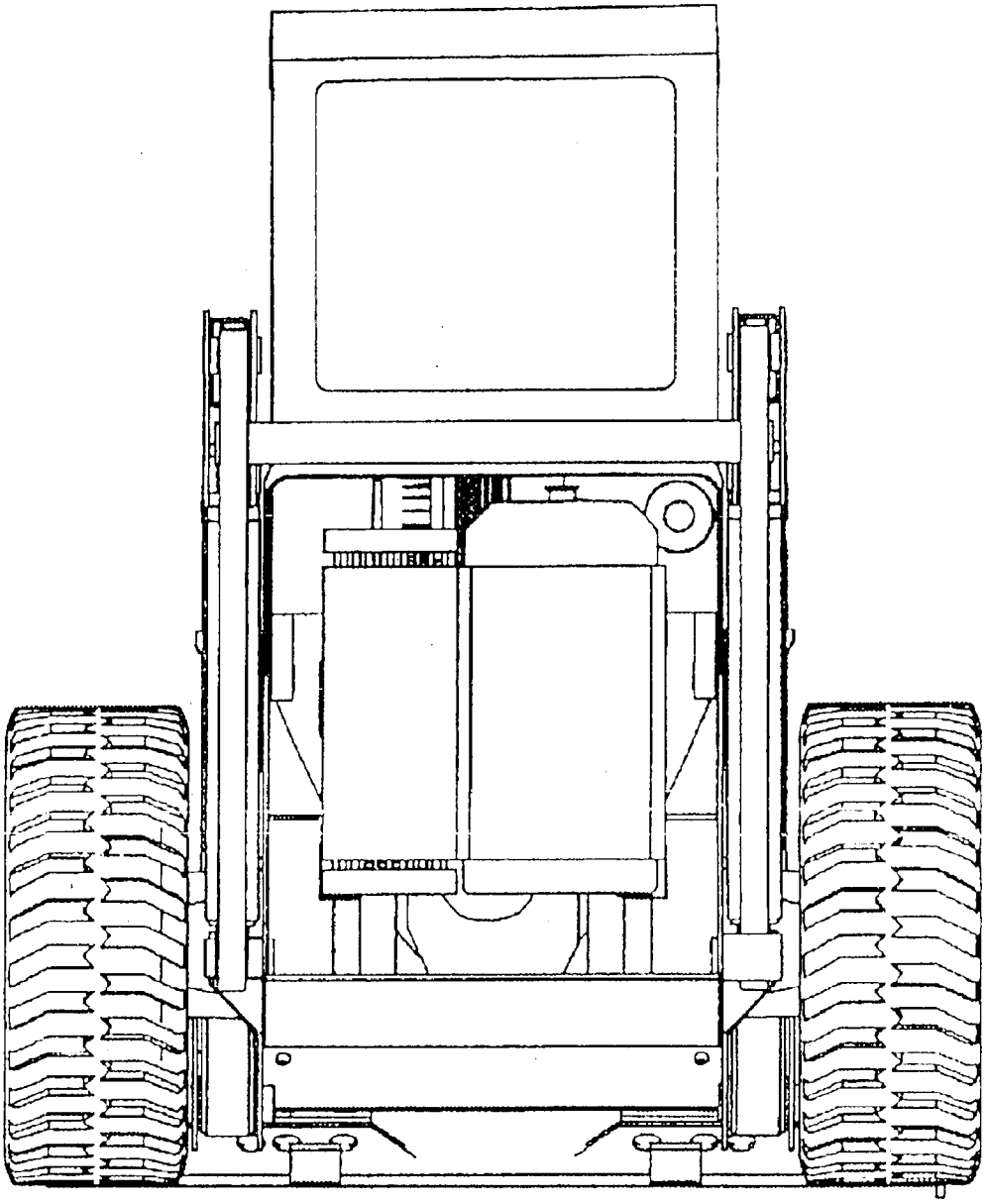
FIG. 11 is a rear view of a skid-steer loader according to the embodiment shown in FIG. 1, with the implement lowered.
Figure 12:
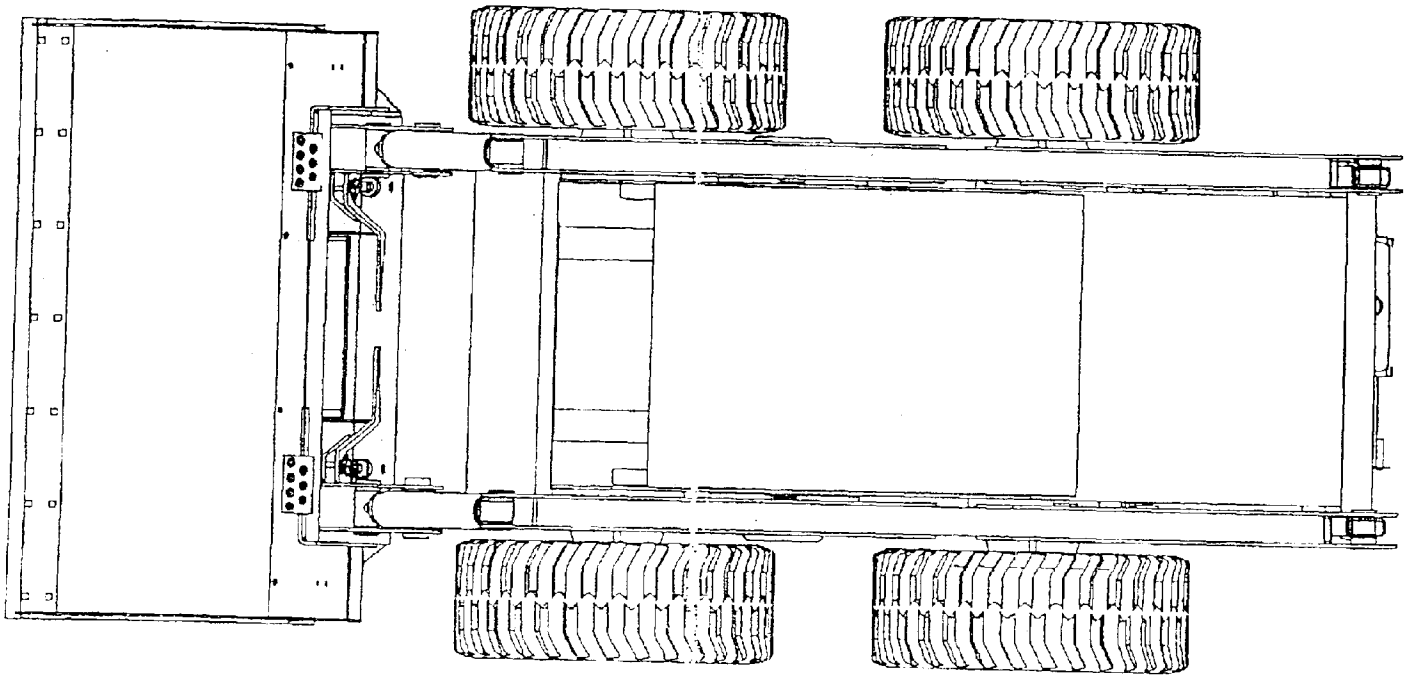
FIG. 12 is a top view of a skid-steer loader according to the embodiment shown in FIG. 1.

Right loader arm 110 is supported by a linkage comprised of guide links in a manner substantially similar to left loader arm 112, as shown in FIG. 5. Some of the elements in the following description of the linkage supporting right loader arm 110 are not shown because they are substantially interchangeable with the corresponding elements supporting left loader arm 112. Furthermore, some of the elements belonging to left loader arm 112 may, in general, be substantially a mirror image of the corresponding element supporting right loader arm 110.

A right forward guide link having a first right lower end portion may be pivotally connected to lower right side 106 of frame 104. Right forward guide link may also have a first right upper end portion pivotally connected substantially between forward and rearward ends 110*f*, 110*r* of right loader arm 110.

First right upper end portion 230 may be offset substantially from a centerline 256 of right loader arm 110. This may reduce a length of right forward guide link. This may also allow right forward guide link to nest underneath right loader arm 110 when right loader arm 110 is in a lowered position. Right forward guide link may be solid, or it may have a section such as a hollow box section, an I-beam, a channel section or an L section. Right forward guide link may have disparate sections of varying size at various points along its length.

A right rearward guide link 132 having a second right lower end portion 134 may be pivotally connected substantially proximate to a rear 136 of lower right side 106 of frame 104 and a second right upper end portion 137 may be pivotally connected substantially proximate to rearward end 110*r* of right loader arm 110. Right rearward guide link 132 may be solid, or it may have a section such as a hollow box section, an I-beam, a channel section, or an L section. Right rearward guide link 132 may have disparate sections of varying size at various points along its length.

Right loader arm 110, right forward guide link, right rearward guide link 132, and lower right side 106 form a right four bar linkage 160 on the right side of skid-steer loader 102. Since right forward guide link may remain generally within an angular range that is substantially symmetric relative to a horizontal plane, right loader arm 110 will move up and down as right forward guide link pivots around first right lower end portion. Since right forward guide link is generally at an angle relative to a horizontal plane, first right lower end portion will react a horizontal force imposed on right loader arm 110 due to pushing an object or plowing with implement 114.

If a motion of rearward end 110*r* were confined to a horizontal plane, right loader arm 110 would seesaw around first right upper end portion as right forward guide link pivoted around first right lower end portion, moving right forward end 110*f* in a substantially vertical line. Since rearward end 110*r* is connected to second right upper end portion 137, however, and second right upper end portion 137 pivots around second right lower end portion 134, right forward end 110*f* moves in an arc.

The motion of right forward end 110*f* will approach a vertical line asymptotically as a length of right rearward guide link 132 gets very, very large. As it is, the motion of right forward end 110*f* may approximate a substantially vertical line; if a length of right rearward guide link 132 is made reasonably long.

The length of right rearward guide link 132 may be made reasonably long by attaching second right lower end portion 134 to a point that is relatively low on lower right side 106. In one embodiment, second right lower end portion, 134 is substantially lower than first right lower end portion. The motion of right forward end 110*f* may also be approximate a substantially vertical line if a rotation of right rearward guide link 132 about second right lower end portion 134 is restricted to a relatively small angle.

Furthermore, if the length of right rearward guide link 132 is made reasonably long and a rotation of right rearward guide link 132 is restricted to a relatively small angle an upper end point of the motion of right forward end 110*f* may be made to be substantially vertical relative to a lower end point of the motion of right forward end 110*f*, even though the motion of right forward end 110*f* between upper end point and lower end point may be slightly circuitous.

A right lift actuator 146 may be connected between lower right side 106 and right loader arm 110 to raise and lower right loader arm 110. Right lift actuator 146 may have a first right lower cylinder portion 146*c* pivotally connected to lower right side 106 between first right lower end portion and second right lower end portion 134. A first right upper rod portion 146*r* of right lift actuator 146 may be pivotally connected substantially intermediate between first right upper end portion 230 and second right upper end portion 137.

First right upper rod portion 146*r* may be slidably disposed in first right lower cylinder portion 146*c* so that first right upper rod portion 146*r* extends and retracts relative to first right lower cylinder portion 146*c*. Right lift actuator 146 may be an hydraulic cylinder, a double-acting hydraulic cylinder, a pneumatic cylinder, a screw jack, and a rack and pinion.

The pair of lift actuators 146, 148 extend and retract to raise pair of loader arms 110, 112 such that implement 114 moves between a fully lowered position 150 and a fully raised position 152. Fully raised position 152 may be located substantially vertically above fully lowered position 150. Right forward guide link may be nested in right loader arm 110, and left forward guide link 126 may be nested in left loader arm 112 when implement 114 is substantially in fully lowered position 150. A portion of a hydraulic flow provided to lift actuators 146, 148 may be diverted to tilt actuators 116, 118 to level implement 114 while it is being raised.

While the invention has been described in detail above, the invention is not intended to be limited to the specific embodiments as described. It is evident that those skilled in the art may now make numerous uses and modifications of and departures from the specific embodiments described herein without departing from the inventive concepts.

What is claimed is:

1. A boom and linkage mechanism for a skid-steer loader comprising:

a frame having a lower right and a lower left side;

a right and a left loader arm located respectively on said lower right and lower left sides of the frame, each of said right and left loader arms having a forward and a rearward end;

an implement vertically pivotally mounted to said forward ends;

a pair of tilt actuators respectively connected between said forward ends and the implement;

a right forward guide link having a first right lower end portion pivotally connected to the lower right side of the frame and a first right upper end portion pivotally connected substantially between said forward and rearward ends of said right loader arm;

a left forward guide link having a first left lower end portion pivotally connected to the lower left side of the frame and a first left upper end portion pivotally connected substantially between said forward and rearward ends of said left loader arm;

a right rearward guide link having a second right lowered portion pivotally connected substantially proximate to a rear of the lower right side of the frame and a second right upper end portion pivotally connected substantially proximate to said rearward end of said right loader arm, said second right lower end portion being substantially lower than said first right lower end portion;

a left rearward guide link having a second left lower end portion pivotally connected substantially proximate to a rear of the lower left side of the frame and a second left upper end portion pivotally connected substantially proximate to said rearward end of said left loader arm, said second left lower end portion being substantially lower than said first left lower end portion;

a right lift actuator having a first right lower cylinder portion pivotally connected to the lower right side of the frame between said first right lower end portion and said second right lower end portion, and a first right upper rod portion pivotally connected substantially between said first right upper end portion and said second right upper end portion; and a left lift actuator having a first left lower cylinder portion pivotally connected to the lower left side of the frame between said first left lower end portion and said second left lower end portion, and a first left upper rod portion pivotally connected substantially between said first left upper end portion and said second left upper end portion;

wherein said pair of lift actuators extend and retract to raise said pair of loader arms such that the implement moves between a fully lowered position and a fully raised position; and wherein said fully raised position is located substantially vertically above said fully lowered position.

2. The boom and linkage mechanism for a skid-steer loader of claim 1, wherein said implement is selected from the group consisting of:

a bucket, a scoop, a shovel, an auger, a snow blower, a plow, a post-hole digger, a dredge, a fork, an air hammer, and a skid.

3. The boom and linkage mechanism for a skid-steer loader of claim 1, wherein said pair of tilt actuators are selected from the group consisting of:

an hydraulic cylinder, a double-acting hydraulic cylinder, a pneumatic cylinder, a screw jack, and a rack and pinion.

4. The boom and linkage mechanism for a skid-steer loader of claim 1, wherein said pair of lift actuators are is selected from the group consisting of:

an hydraulic cylinder, a double-acting hydraulic cylinder, a pneumatic cylinder, a screw jack, and a rack and pinion.

5. The boom and linkage mechanism for a skid-steer loader of claim 1, wherein said right and left loader arms are substantially L-shaped and said pair of tilt actuators are connected to a bend of a respective one of said right and left loader arms.

6. The boom and linkage mechanism for a skid-steer loader of claim 1, wherein said first right upper end portion is offset substantially from a centerline of said right loader arm; and said first left upper end portion is offset substantially from a centerline of said left loader arm.

7. The boom and linkage mechanism for a skid-steer loader of claim 1, wherein a portion of a hydraulic flow provided to said lift actuator is diverted to said tilt actuators to level said implement.

8. The boom and linkage mechanism for a skid-steer loader of claim 1, wherein said right forward guide link is nested in said right load arm, and said left forward guide link is nested in said left loader arm when said implement is substantially in said fully lowered position.

* * * * *